US012760227B2

(12) United States Patent
Singh et al.

(10) Patent No.: US 12,760,227 B2
(45) Date of Patent: Oct. 13, 2026

(54) PROCESSES AND SYSTEMS FOR FRACTIONATING A PYROLYSIS EFFLUENT

(71) Applicant: ExxonMobil Chemical Patents Inc., Baytown, TX (US)

(72) Inventors: Vikram Singh, Houston, TX (US); James R. Arnold, Highlands Ranch, CO (US); Selma S. Lawrence, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 17/624,985

(22) PCT Filed: Jul. 22, 2020

(86) PCT No.: PCT/US2020/042993

§ 371 (c)(1),
(2) Date: Jan. 5, 2022

(87) PCT Pub. No.: WO2021/016306

PCT Pub. Date: Jan. 28, 2021

(65) Prior Publication Data

US 2022/0267680 A1 Aug. 25, 2022

Related U.S. Application Data

(60) Provisional application No. 62/877,890, filed on Jul. 24, 2019.

(30) Foreign Application Priority Data

Nov. 5, 2019 (EP) ..... 19207059

(51) Int. Cl.

| | |
|---|---|
| ***C10G 9/36*** | (2006.01) |
| ***C10G 7/12*** | (2006.01) |
| ***C10G 51/02*** | (2006.01) |

(52) U.S. Cl.
CPC ..... *C10G 9/36* (2013.01); *C10G 7/12* (2013.01); *C10G 51/023* (2013.01); *C10G 2400/20* (2013.01); *C10G 2400/30* (2013.01)

(58) Field of Classification Search
CPC ... C10G 9/36; C10G 7/12; C10G 7/00; C10G 51/023; C10G 2400/20; C10G 2400/30
See application file for complete search history.

(56) References Cited

U.S. PATENT DOCUMENTS 1,392,584 A * 10/1921 Lewis ..... C10G 7/00 196/139
2,581,051 A * 1/1952 Smith ..... B01D 3/14 196/140

(Continued)

FOREIGN PATENT DOCUMENTS

| | | |
|---|---|---|
| WO | 2011/014345 A1 | 2/2011 |
| WO | 2018/111574 A1 | 6/2018 |
| WO | 2021/016306 A1 | 1/2021 |

OTHER PUBLICATIONS

Kister, Z.H., "Distillation Design", McGraw-Hill Inc., vol. 1, 1992, pp. 262-265 & 464-466.

*Primary Examiner* — Michelle Stein
(74) *Attorney, Agent, or Firm* — Kevin Davis; WOMBLE BOND DICKINSON (US) LLP

(57) ABSTRACT

The process can include transferring heat from a light product in a first heat exchange stage to produce a cooled product and a first medium pressure steam and separating a steam cracker quench oil therefrom. Heat can be transferred from the steam cracker quench oil in a second heat exchange stage to produce a first cooled quench oil and a second medium pressure steam. Heat can be transferred from at least a portion of the first cooled quench oil in a third heat exchange stage to produce a second cooled quench oil and low pressure steam. A total heat duty generated in the first (Continued)

heat exchange stage, the second heat exchange stage, and the third heat exchange stage can be equal to $Q_{T1}$ and a heat duty generated in the first heat exchange stage and the second heat exchange stage can be ≥0.5 $Q_{T1}$ joules/sec.

23 Claims, 2 Drawing Sheets

(56) References Cited

U.S. PATENT DOCUMENTS 2,890,256 A * 6/1959 King ..... C07C 4/04 208/132
3,105,862 A * 10/1963 Doering, Jr. ..... B01D 3/163 261/114.1
3,923,921 A * 12/1975 Kohfeldt ..... C10G 9/002 208/100
4,321,130 A * 3/1982 Bacsik ..... C10G 9/14 585/602
5,215,649 A * 6/1993 Grenoble ..... C10G 47/34 208/48 R
6,419,885 B1 7/2002 Di et al.
6,632,351 B1 10/2003 Ngan et al.
7,090,765 B2 8/2006 Spicer et al.
7,097,758 B2 8/2006 Stell et al.
7,138,047 B2 11/2006 Stell et al.
7,220,887 B2 5/2007 Stell et al.
7,235,705 B2 6/2007 Stell
7,244,871 B2 7/2007 Stell et al.
7,247,765 B2 7/2007 Stell et al.
7,297,833 B2 11/2007 Beattie et al.
7,311,746 B2 12/2007 Stell et al.
7,312,371 B2 12/2007 Stell et al.
7,351,872 B2 4/2008 Stell et al.
7,465,399 B1 12/2008 Hoeptner, III
7,488,459 B2 2/2009 Stell et al.
7,578,929 B2 8/2009 Stell et al.
7,674,366 B2 3/2010 Strack et al.
7,749,372 B2 7/2010 Strack et al.
7,763,162 B2 7/2010 Strack
7,820,035 B2 10/2010 Mccoy et al.
7,981,374 B2 7/2011 Strack et al.
7,993,435 B2 8/2011 Stell et al.
8,083,931 B2 12/2011 Mccoy et al.
8,524,070 B2 9/2013 Strack et al.
8,696,888 B2 4/2014 Keusenkothen et al.
9,090,836 B2 7/2015 Brown et al.
9,327,260 B2 5/2016 Davis et al.
9,637,694 B2 5/2017 Evans et al.
9,657,239 B2 5/2017 Beech, Jr. et al.
9,777,227 B2 10/2017 Soultanidis et al.
2007/0007169 A1* 1/2007 Strack ..... C10G 9/002 422/198
2007/0007171 A1* 1/2007 Strack ..... C10G 9/00 422/600
2007/0007172 A1* 1/2007 Strack ..... C10G 9/002 422/600
2008/0146857 A1* 6/2008 Verma ..... C10G 31/08 422/600
2009/0074636 A1* 3/2009 Strack ..... C10G 9/002 422/198
2009/0301935 A1* 12/2009 Spicer ..... C10G 9/20 208/125
2011/0005970 A1* 1/2011 Ou ..... C10G 51/04 208/44
2012/0024749 A1* 2/2012 Strack ..... C10G 9/002 208/103
2014/0061094 A1* 3/2014 Xu ..... C10G 9/36 208/15
2014/0061100 A1* 3/2014 Lattner ..... C10G 31/06 208/48 Q
2015/0315496 A1* 11/2015 Soultanidis ..... C10G 69/06 208/68
2019/0375992 A1* 12/2019 Karime ..... B01J 19/0026

* cited by examiner

PROCESSES AND SYSTEMS FOR FRACTIONATING A PYROLYSIS EFFLUENT

CROSS-REFERENCE TO RELATED APPLICATIONS

This application is a US national phase application of PCT Application Serial No. PCT/US2020/042993 having a filing date of Jul. 22, 2020, which claims priority to and the benefit of U.S. Provisional Application No. 62/877,890, filed Jul. 24, 2019, and European Patent Application No. 19207059.7 which was filed Nov. 5, 2019, the disclosures of which are incorporated herein by reference in their entireties.

FIELD

Embodiments disclosed herein generally relate to processes and systems for separating a pyrolysis effluent, e.g., a steam cracker effluent, into a plurality of products. More particularly, such processes and systems relate to recovering heat and/or an increased quantity of one or more products, e.g., ethylene, from the pyrolysis effluent.

BACKGROUND

Pyrolysis processes, e.g., steam cracking, convert saturated hydrocarbons to higher value products, e.g., light olefins such as ethylene and propylene. In addition to these higher value products, however, pyrolysing hydrocarbons also produces naphtha, gas oil, quench oil, and a significant amount of relatively low-value heavy products such as pyrolysis tar. As plants are revamped or newly built to produce an increased amount of the higher-value products, e.g., ethylene, the primary fractionator can be a limiting factor. More particularly, as the amount of higher value products increase, the volume of the pyrolysis effluent that needs to be processed through the primary fractionator also increases.

As the volume of the pyrolysis effluent increases, the size of the primary fractionator generally needs to be increased to accommodate the additional pyrolysis effluent. Increasing the diameter of the primary fractionator, e.g., to >16.8 m (about 55 ft), however, may not be possible simply due to structural limitations associated with building such a large fractionator. Additionally, constructing a second primary fractionator to accommodate the increased amount of pyrolysis effluent is not only costly, but may not be possible due to the limited area typically available in a refinery. Furthermore, the increased amount of pyrolysis effluent means that more heat needs to be recovered from the pyrolysis effluent and/or products separated therefrom. The recovery of heat by cooling the pyrolysis effluent and/or products recovered from the primary fractionator is often inefficient.

There is a need, therefore, for improved pyrolysis processes and systems capable of producing an increased amount of higher valued products, e.g., ≥1,200 KTA of ethylene, while using a single primary fractionator having a diameter of ≤16.8 meters. There is also a need for improved pyrolysis processes and systems capable of more efficiently recovering heat from a pyrolysis effluent during separation of products therefrom.

SUMMARY

Processes and systems for fractionating a pyrolysis effluent are provided. In some examples, the process for fractionating a steam cracker effluent can include contacting a steam cracker effluent with a quench oil to produce a cooled steam cracker effluent. A tar product and a light product can be separated from the cooled steam cracker effluent. Heat can be indirectly transferred from the light product to a first heat transfer medium in a first heat exchange stage to produce a cooled light product and a first heated heat transfer medium. The cooled light product can be introduced into a primary fractionator. A steam cracker quench oil, a steam cracker gas oil, and an overhead product can be separated from the primary fractionator. The overhead product can include steam cracker naphtha and a process gas comprising ethylene. The steam cracker naphtha and the process gas can be separated from the overhead product. Heat can be indirectly transferred from the steam cracker quench oil to a second heat transfer medium in a second heat exchange stage to produce a first cooled steam cracker quench oil and a second heated heat transfer medium. Heat can be indirectly transferred from at least a portion of the first cooled steam cracker quench oil to a third heat transfer medium in a third heat exchange stage to produce a second cooled steam cracker quench oil and a third heated heat transfer medium. At least a portion of the second cooled steam cracker quench oil can be introduced into the primary fractionator as a quench medium. A total heat duty equal to a sum of heat duties generated in the first heat exchange stage, the second heat exchange stage, and the third heat exchange stage can be equal to $Q_{T1}$ joules/sec. A heat duty equal to a sum of heat duties generated in the first heat exchange stage and the second heat exchange stage can be ≥0.5 $Q_{T1}$ joules/sec. A heat duty generated in the third heat exchange stage can be <0.5 $Q_{T1}$ joules/sec.

In other examples, the process for fractionating a steam cracker effluent can include contacting a steam cracker effluent with a quench fluid to produce a cooled steam cracker effluent. A tar product and a light product can be separated from the cooled steam cracker effluent. Heat can be indirectly transferred from the light product to water, steam, or a mixture of water and steam to produce a cooled light product and a first medium pressure steam. The first medium pressure steam can be at a pressure of about 827 kPag to about 1,720 kPag. The cooled light product can be introduced into a primary fractionator having a maximum inner diameter of ≤16.8 meters. A steam cracker quench oil, a steam cracker gas oil, and an overhead product can be separate from the primary fractionator. The overhead product can include steam cracker naphtha and a process gas comprising ethylene. The steam cracker naphtha and the process gas can be separated from the overhead product. Ethylene in an amount ≥136 tonnes per hour can be separated from the overhead product. The steam cracker quench oil can be cooled by indirect heat exchange with water, steam, or a mixture of water and steam to produce a first cooled steam cracker quench oil and a second medium pressure steam. The second medium pressure steam can be at a pressure of about 827 kPag to about 1,720 kPag. At least a portion of the first cooled steam cracker quench oil can be cooled by indirect heat exchange with water, steam, or a mixture of water and steam to produce a second cooled steam cracker quench oil and low pressure steam. The low pressure steam can be at a pressure of <827 kPag. At least a portion of the second cooled steam cracker quench oil can be introduced into the primary fractionator a quench medium.

In some examples, a system for fractionating a steam cracker effluent can include a steam cracker that can include a steam cracker effluent outlet; a quench stage that can include a quench stage inlet in fluid communication with the steam cracker effluent outlet, a quench oil inlet, and a quench stage outlet; a tar knockout drum that can include an inlet in fluid communication with the quench stage outlet, a tar product outlet, and a light product outlet; a first heat exchange stage that can include a first heat exchange stage inlet in fluid communication with the light product outlet and a first heat exchange stage outlet, the first heat exchange stage can be configured to produce medium pressure steam at a pressure of about 827 kPag to about 1,720 kPag; a primary fractionator; and a bottom pump-around loop. The primary fractionator can include a fractionator inlet in fluid communication with the first heat exchange stage outlet, a bottoms outlet, a bottom pump-around inlet, a top pump-around outlet located above the bottom pump-around inlet, a top pump-around inlet located above the top pump-around outlet, a reflux inlet located above the top pump-around inlet, and an overhead outlet located above the reflux inlet. The bottom pump-around loop can fluidly connect the bottoms outlet to the bottom pump-around inlet. The bottom pump-around loop can include a second heat exchange stage and a third heat exchange stage. The second heat exchange stage can be configured to produce medium pressure steam at a pressure of about 827 kPag to about 1,720 kPag. The third heat exchange stage can be configured to produce low pressure stem at a pressure of <827 kPag. The first heat exchange stage, the second heat exchange stage, and the third heat exchange stage can be configured to generate a total heat duty that is equal to $Q_{T1}$ joules/sec. The first heat exchange stage and the second heat exchange stage can be configured to generate a heat duty that is ≥0.5 $Q_{T1}$ joules/sec. The third heat exchange stage can configured to generate a heat duty that is <0.5 $Q_{T1}$ joules/sec.

In other examples, the process for fractionating a steam cracker effluent can include contacting a steam cracker effluent with a quench fluid to produce a cooled steam cracker effluent. The steam cracker effluent can be at a temperature of ≥400° C. when initially contacted with the quench fluid. A tar product and a light product can be separated from the cooled steam cracker effluent. The light product can be substantially in a vapor phase and at a temperature of ≥155° C. to ≤315° C. The light product can be cooled by indirect heat exchange with water, steam, or a mixture of water and steam to produce a cooled light product and a first medium pressure steam. The cooled light product can be at a temperature of ≥150° C. to ≤300° C. The first medium pressure steam can be at a pressure of about 827 kPag to about 1,720 kPag. The cooled light product can be in the vapor phase and liquid phase. The cooled light product can be introduced into a flash zone section of a primary fractionator. The cooled light product can be at a temperature of ≥150° C. to ≤280° C. when introduced into the primary fractionator. The primary fractionator can include the flash zone section located toward a bottom of the primary fractionator, a bottom pump-around section located above the flash zone, a mid-fractionation section located above the bottom pump-around section, a top pump-around section located above the mid-fractionation section, and a top-fractionation section located above the top pump-around section. One or more first trays can be disposed within the bottom pump-around section, one or more second trays can be disposed within the mid-fractionation section, one or more third trays can disposed within the top pump-around section, and one or more fourth trays can be disposed in the top-fractionation section. A steam cracker quench oil can be separated from the flash zone section. A steam cracker gas oil can be separated from the mid-fractionation section. An overhead product that can include steam cracker naphtha and a process gas that can include ethylene can be separated from the top-fractionation section. The steam cracker naphtha and the process gas can be separated from the overhead product. The steam cracker naphtha can have a final atmospheric boiling point of ≤260° C., as measured according to ASTM D2887-18. The steam cracker quench oil can be cooled by indirect heat exchange with water, steam, or a mixture of water and steam to produce a first cooled steam cracker quench oil and a second medium pressure steam. The second medium pressure steam can be at a pressure of about 827 kPag to about 1,720 kPag. At least a portion of the first cooled steam cracker quench oil can be cooled by indirect heat exchange with water, steam, or a mixture of water and steam to produce a second cooled steam cracker quench oil and low pressure steam. The low pressure steam can be at a pressure of <827 kPag. A portion of the steam cracker naphtha can be introduced into the top-fractionation section. The steam cracker naphtha can be introduced into the top-fractionation section, relative to a weight of hydrocarbons in the steam cracker effluent, at a weight ratio of about 0.2:1 to about 0.45:1.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
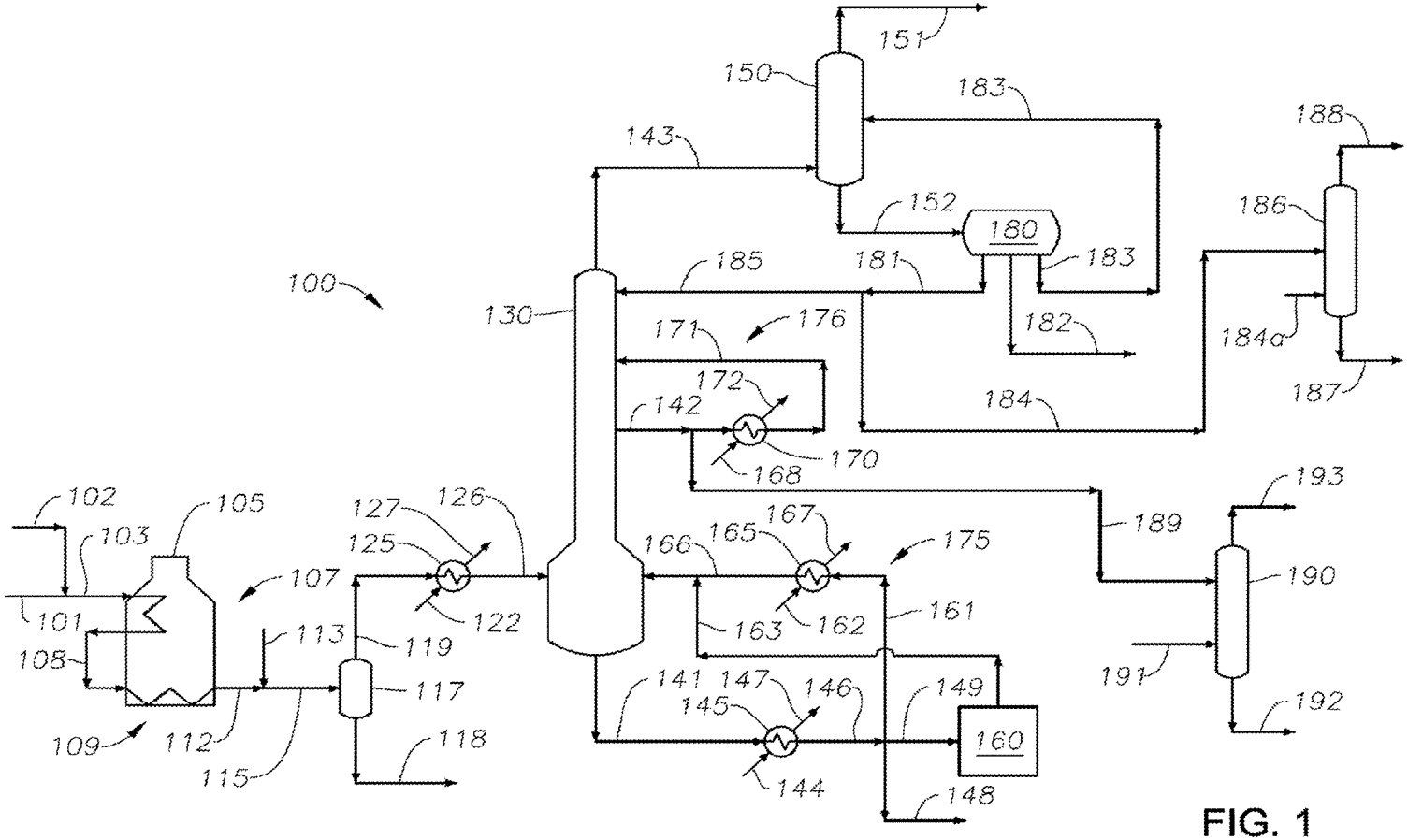
FIG. 1 depicts a schematic of an illustrative system for steam cracking a hydrocarbon feed to produce a steam cracker effluent and separating a plurality of products therefrom, according to one or more embodiments described.

It is to be understood that the following disclosure describes several exemplary embodiments for implementing different features, structures, and/or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the exemplary embodiments presented below can be combined in any combination of ways, i.e., any element from one exemplary embodiment can be used in any other exemplary embodiment, without departing from the scope of the disclosure.

An effluent from a pyrolysis process exits a pyrolysis reactor, e.g., a steam cracker, at an elevated temperature. The effluent needs to be cooled prior to separating, e.g., via fractionation, the effluent into various products. The recovery of heat from the effluent during this cooling and separation can reduce or minimize energy costs associated with the overall pyrolysis process. It has been discovered that the combination of one or more first heat exchange stages and a pump-around loop in fluid communication with a primary fractionator, the pump-around loop including one or more second heat exchange stages and one or more third heat exchange stages, can significantly improve the energy efficiency of the pyrolysis process.

The first heat exchange stage can cool a pyrolysis effluent, e.g., a steam cracker effluent or a product separated therefrom, to produce a cooled pyrolysis effluent. The second heat exchange stage and the third heat exchange stage can cool a product, e.g., a steam cracker quench oil or a portion thereof, separated from the cooled pyrolysis effluent. In some examples, the first heat exchange stage can cool the pyrolysis effluent to a temperature of ≤300° C., e.g., about 160° C. to about 250° C. The second heat exchange stage and the third heat exchange stage can cool the product or portion thereof separated from the cooled pyrolysis effluent to a temperature of ≤200° C., e.g., about 155° C. to about 180° C. The first heat exchange stage and the second heat exchange stage can generate medium pressure steam and the third heat exchange stage can generate low pressure steam. The medium pressure steam can be at a pressure of about 827 kPag to about 1,720 kPag and the low pressure steam can be at a pressure of <827 kPag.

A total heat duty equal to a sum of heat duties generated in the first heat exchange stage, the second heat exchange stage, and the third heat exchange stage can be equal to $Q_{T1}$, where $Q_{T1}$ is in joules/sec. In some examples, a heat duty equal to a sum of heat duties generated in the first heat exchange stage and the second heat exchange stage can be ≥0.5 $Q_{T1}$ and the heat duty generated in the third heat exchange stage can be <0.5 $Q_{T1}$. In other examples, the heat duty equal to the sum of heat duties generated in the first heat exchange stage and the second heat exchange stage can be ≥0.5 $Q_{T1}$, ≥0.51 $Q_{T1}$, ≥0.52 $Q_{T1}$, ≥0.53 $Q_{T1}$, ≥0.54 $Q_{T1}$, ≥0.55 $Q_{T1}$, ≥0.56 $Q_{T1}$, ≥0.57 $Q_{T1}$, ≥0.58 $Q_{T1}$, ≥0.59 $Q_{T1}$, ≥0.6 $Q_{T1}$, ≥0.62 $Q_{T1}$, ≥0.65 $Q_{T1}$, ≥0.67 $Q_{T1}$, or ≥0.7 $Q_{T1}$ and ≤0.95 $Q_{T1}$, ≤0.92 $Q_{T1}$, ≤0.9 $Q_{T1}$, ≤0.88 $Q_{T1}$, or ≤0.85 $Q_{T1}$. In other examples, the heat exchange duty equal to the sum of heat duties generated in the first heat exchange stage and the second heat exchange stage can be about 0.5 $Q_{T1}$, about 0.55 $Q_{T1}$, about 0.6 $Q_{T1}$, about 0.65 $Q_{T1}$, or about 0.7 $Q_{T1}$, to about 0.8 $Q_{T1}$, about 0.85 $Q_{T1}$, about 0.9 $Q_{T1}$, or about 0.95 $Q_{T1}$.

In some examples, a pyrolysis system can include the first heat exchange stage, a first or bottom pump-around loop in fluid communication with the primary fractionator, and a second or top pump-around loop in fluid communication with the primary fractionator. The bottom pump-around loop can include the second heat exchange stage and the third heat exchange stage discussed above. The top pump-around loop can include one or more fourth heat exchange stages. The fourth heat exchange stage can cool a product or a portion thereof, e.g., a steam cracker gas oil, separated from the pyrolysis effluent. In some examples, the fourth heat exchange stage can cool the product separated from the pyrolysis effluent to a temperature of ≤170° C., e.g., about 130° C. to about 150° C. The first heat exchange stage and the second heat exchange stage can generate medium pressure steam and the third heat exchange stage and the fourth heat exchange stage can generate low pressure steam or can be configured to operate as a process heater. The medium pressure steam can be at a pressure of about 827 kPag to about 1,720 kPag and the low pressure steam can be at a pressure of <827 kPag.

A total heat duty equal to a sum of heat duties generated in the first heat exchange stage, the second heat exchange stage, the third heat exchange stage, and the fourth heat exchange stage can be equal to $Q_{T2}$, where $Q_{T2}$ is in joules/sec. In some examples, the heat duty generated in the fourth heat exchange stage can be about 0.01 $Q_{T2}$, about 0.03 $Q_{T2}$, about 0.05 $Q_{T2}$, about 0.07 $Q_{T2}$, or about 0.09 $Q_{T2}$ to about 0.13 $Q_{T2}$ about 0.15 $Q_{T2}$, about 0.17 $Q_{T2}$, about 0.2 $Q_{T2}$, about 0.23 $Q_{T2}$, or about 0.25 $Q_{T2}$. In some examples the heat exchange duty equal to the sum of heat duties generated in the third heat exchange stage and the fourth heat exchange stage can be ≤0.6 $Q_{T2}$, ≤0.55 $Q_{T2}$, ≤0.5 $Q_{T2}$, ≤0.45 $Q_{T2}$, ≤0.43 $Q_{T2}$, or ≤0.4 $Q_{T2}$. In some examples, the heat exchange duty equal to the sum of heat duties generated in the first heat exchange stage and the second heat exchange stage can be ≥0.4 $Q_{T2}$, ≥0.43 $Q_{T2}$, ≥0.45 $Q_{T2}$, ≥0.5 $Q_{T2}$, ≥0.55 $Q_{T2}$, ≥0.57 $Q_{T2}$, or ≥0.6 $Q_{T2}$.

The heat exchange duty equal to the sum of heat duties generated in the first heat exchange stage and the second heat exchange stage can be greater than the heat exchange duty equal to the sum of heat duties generated in the third heat exchange stage and the fourth heat exchange stage. In some examples, the heat exchange duty equal to the sum of heat duties generated in the first heat exchange stage and the second heat exchange stage can be ≥0.5 $Q_{T2}$, ≥0.53 $Q_{T2}$, ≥0.55 $Q_{T2}$, ≥0.57 $Q_{T2}$, ≥0.6 $Q_{T2}$, ≥0.63 $Q_{T2}$, ≥0.65 $Q_{T2}$, ≥0.67 $Q_{T2}$, or ≥0.7 $Q_{T2}$. In some specific examples, the heat duty generated in the first heat exchange stage can be ≥0.5 $Q_{T2}$, the heat duty generated in the second heat exchange stage can be ≤0.15 $Q_{T2}$, the heat duty generated in the third heat exchange stage can be ≥0.15 $Q_{T2}$ and ≤0.3 $Q_{T2}$, and the heat duty generated in the fourth heat exchange stage can be ≥0.05 $Q_{T2}$, and ≤0.15 $Q_{T2}$. In other specific embodiments, the heat duty generated in the first heat exchange stage can be ≥0.55 $Q_{T2}$, the heat duty generated in the second heat exchange stage can be ≥0.05 $Q_{T2}$ and ≤0.1 $Q_{T2}$, the heat duty generated in the third heat exchange stage can be ≥0.15 $Q_{T2}$ and ≤0.3 $Q_{T2}$, and the heat duty generated in the fourth heat exchange stage can be ≥0.05 $Q_{T2}$, and ≤0.15 $Q_{T2}$.

It has also been discovered that the use of the one or more first heat exchange stages in combination with the second heat exchange stage and the third heat exchange stage in the bottom pump-around loop can allow for a significant increase in the production of olefins, e.g., ≥136 tonnes per hour of ethylene, while maintaining a maximum inner diameter of the primary fractionator within acceptable design parameters, e.g., ≤16.8 m. In some examples, ≥136, ≥142, ≥150, ≥176, or ≥194 tonnes per hour of ethylene can be recovered from the process and a maximum inner diameter of the primary fractionator can be ≤16.8 m, ≤16.5 m, ≤16.1 m, ≤15.5 m, or ≤15.2 m. It should be understood that in some examples the olefin production can be ≥136 tonnes per hour of ethylene, but in other examples the olefin production can be less. In some examples, the production of olefins, e.g., ethylene, can be ≥1, ≥10, ≥50, ≥57, ≥75, ≥100, ≥125, 136, ≥142, ≥150, ≥176, or ≥194 tonnes per hour of ethylene.

In some examples, one or more trays having one or more liquid passes can be disposed within a bottom pump-around section of the primary fractionator. It has also been discovered that increasing the number of liquid passes in the tray(s) disposed within the bottom pump-around section of the primary fractionator can allow the inner diameter of the primary fractionator to be further reduced for a given amount of olefin production, e.g., ethylene, recovered in the process. In some examples, the trays can include one liquid pass, two liquid passes, three liquid passes, four liquid passes, five liquid passes, or more. In some examples, with all process variables remaining the same except for the number of liquid passes in trays increasing from 2 to 4, the maximum inner diameter of the primary fractionator can be decreased by ≥1%, ≥2%, ≥3%, ≥4%, ≥5%, ≥6%, ≥7%, or more. In other examples, with all process variables remaining the same except for the number of liquid passes in trays increasing from 4 to 6, the maximum inner diameter of the primary fractionator can be decreased by ≥0.5%, ≥1%, ≥1.5%, ≥2%, ≥2.5%, ≥3%, ≥3.5%, or ≥4%. In still other examples, with all process variables remaining the same except for the number of liquid passes in trays increasing from 6 to 8, the maximum inner diameter of the primary fractionator can be decreased by ≥0.5%, ≥1%, ≥1.5%, ≥2%, ≥2.5%, ≥3%, ≥3.5%, or ≥4%.

For simplicity and ease of description, the pyrolysis process will be further described in the context of a steam cracking process. FIG. 1 depicts a schematic of an illustrative system 100 for steam cracking a hydrocarbon feed in line 101 to produce a steam cracker effluent via line 112 and separating a plurality of products therefrom, according to one or more embodiments. The hydrocarbon in line 101 can be mixed, blended, combined, or otherwise contacted with water, steam, or a mixture thereof in line 102 to produce a mixture in line 103. The mixture in line 103 can be heated within a convection section 107 of a steam cracker 105 to produce a heated mixture in line 108. The heated mixture in line 108 can be heated and subjected to steam cracking conditions within a radiant section 109 of the steam cracker 105 to produce the steam cracker effluent via line 112.

Illustrative steam cracking conditions can include, but are not limited to, one or more of: exposing the heated mixture of the hydrocarbon feed and steam in line 108 or a vapor phase product separated therefrom to a temperature (as measured at a radiant outlet of a steam cracking apparatus) of ≥400° C., e.g., a temperature of about 700° C., about 800° C., or about 900° C. to about 950° C., a pressure of about 0.1 bar to about 5 bars (absolute), and/or a steam cracking residence time of about 0.01 seconds to about 5 seconds. In some examples, the heated mixture in line 108 or a vapor phase product separated therefrom can be steam cracked according to the processes disclosed in U.S. Pat. Nos. 6,419,885; 7,993,435; 9,637,694; and 9, 777,227; and International Patent Application Publication No. WO 2018/111574.

In some examples, the steam cracker effluent in line 112 can be at a temperature of ≥300° C., ≥400° C., ≥500° C., ≥600° C., or ≥700° C., or ≥800° C., or more. In certain aspects, the temperature of the steam cracker effluent in line 112 can be about 425° C. to 850° C., e.g., about 450° C. to about 800° C., when initially contacted with the quench fluid in line 113. In some examples, the mixture in line 103 can be steam cracked according to the processes and systems disclosed in U.S. Pat. Nos. 6,419,885; 7,993,435; 9,637,694; and 9,777,227; and International Patent Application Publication No. WO 2018/111574.

In some examples, a quench fluid via line 113 can be mixed, blended, combined, or otherwise contacted with the steam cracker effluent in line 112 to produce a cooled steam cracker effluent via line 115. The amount of quench fluid contacted with the steam cracker effluent in line 112 can vary considerably from facility to facility, but the quench fluid to steam cracker effluent weight ratio is typically in the range of about 0.1:1 to about 10:1, e.g., about 0.5:1 to about 5:1, such as about 1:1 to about 4:1. The cooled steam cracker effluent in line 115 can be at a temperature of ≥150° C., e.g., about 155° C. to about 350° C. once contacted with the quench fluid. The desired quench fluid to steam cracker effluent weight ratio in a particular instance can be determined, e.g., from factors such as the amount of steam cracker effluent to be cooled, the temperature of the steam cracker effluent at the quenching location, the composition and thermodynamic properties (e.g., enthalpy, CP, etc.) of the quench fluid and the steam cracker effluent, the desired temperature of the cooled steam cracker effluent at the primary fractionator inlet, etc. For example, in certain aspects the cooled steam cracker effluent can include the quench fluid in an amount of about 5 wt. % to about 95 wt. %, about 25 wt. % to about 90 wt. %, or about 50 wt. %, or about 80 wt. %, based on the weight of the cooled steam cracker effluent.

In some examples, the quench fluid can be or include a recycled steam cracker quench oil separated from the steam cracker effluent in a primary fractionator 130 described in more detail below. In some examples, the quench fluid can be the same or similar to the utility fluids disclosed in U.S. Pat. Nos. 9,090,836; 9,637,694; and 9,777,227; and International Patent Application Publication No. WO 2018/111574. In some examples, in addition to or in lieu of contacting the steam cracker effluent with a quench fluid, heat can be indirectly exchanged from the steam cracker effluent to water, steam, or a mixture of water and stem in one or more heat exchange stages, e.g., a transfer line exchanger, to produce the cooled steam cracker effluent via line 115.

The steam cracker effluent in line 112 or the cooled steam cracker effluent via line 115 can be introduced into one or more separation stages 117, e.g., a tar knock out drum, to separate a tar product and a light product that can be conducted away via lines 118 and 119, respectively. In some examples, illustrative separation stages can include those disclosed in U.S. Pat. No. 8,083,931. The light product in line 119 can be at a temperature of about 155° C., about 175° C., about 200° C., or about 225° C. to a about 250° C., about 270° C., about 290° C., about 300° C., or about 315° C. In some examples, the light product in line 119 can be at a temperature of ≥155° C. to ≤315° C. such as about 250° C. to ≤315° C. The tar product in line 118 can have a final atmospheric boiling point of >600° C., as measured according to ASTM D2887-18.

The light product via line 119 can be introduced into one or more first heat exchange stages 125 to produce a cooled light product via line 126. For example, heat can be indirectly transferred within the first heat exchange stage from the light product to a first heat transfer medium introduced via line 122 to produce the cooled light product via line 126 and a heated first heat transfer medium via line 127. In some examples, the first heat transfer medium in line 122 can be water, steam, or a mixture of water and steam and the heated first heat transfer medium in line 127 can be medium pressure steam at a pressure of about 827 kPag to about 1,720 kPag. In some examples, at least a portion of the steam cracker effluent in line 112 or the cooled steam cracker effluent in line 115 can be in a vapor or gaseous phase. As such, the first heat exchange stage 125 can be referred to as a vapor cooler stage or simply a vapor cooler. Illustrative first heat exchange stages 125 can include one or more of the heat exchange stages or exchangers disclosed in U.S. Pat. Nos. 7,465,399; 7,674,366; 7,749,372; 7,763,162; 7,981,374; and 8,524,070. If the first heat exchange stage 125 includes a plurality of heat exchangers, the heat exchangers can be arranged in any suitable configuration, e.g., series, parallel, or a combination thereof, with respect to one another.

The cooled light product in line 126 can be at a temperature of about 150° C., about 165° C., about 195° C., or about 220° C. to a about 230° C., about 250° C., about 270° C., about 285° C., or about 300° C. In some examples, the cooled light product in line 126 can be at a temperature of about 150° C. to about 300° C., about 175° C. to about 280° C., or about 200° C. to about 250° C. In some examples, the cooled light product in line 126 can be at a temperature of ≤300° C. such as ≤280° C. In some examples, the light product in line 119 can be at a temperature of about 155° C. to about 315° C. and the cooled light product in line 126 can be at a temperature of about 150° C. to about 300° C. In other examples, light product in line 119 can be at a temperature of about 200° C. to about 315° C. and the cooled light product in line 126 can be at a temperature of about 150° C. to about 265° C. In still other examples, light product in line 119 can be at a temperature of about 280° C. to about 315° C. and the cooled light product in line 126 can be at a temperature of about 200° C. to about 235° C.

The cooled light product via line 126 can be introduced into the primary fractionator 130. A plurality of products can be separated from the cooled light product and conducted away from the primary fractionator 130. Illustrative products that can be separated from the cooled light product in line 126 within the primary fractionator 130 and conducted away therefrom can include, but are not limited to, a steam cracker quench oil via line 141, a steam cracker gas oil via line 142, and an overhead product via line 143. The overhead product via line 143 can be introduced into a quench tower 150 along with quench water, e.g., a recycled quench water, via line 183 to cool the overhead product. A process gas that can include ethylene can be recovered via line 151 and a mixture that includes steam cracker naphtha and quench water via line 152 can be conducted away from the quench tower 150. It should be understood that, while shown as being separate vessels, the quench tower 150 can be integrated with the primary fractionator 130.

The steam cracker quench oil in line 141 can have a viscosity of about 250 cP, about 500 cP, about 750 cP, about 900 cP, about 950 cP, or about 1,000 cP to about 1,500 cP, about 2,000 cP, about 2,500 cP, or about 3,000 cP at a temperature of about 60° C., as measured according to ASTM D2171/D2171M-18. In some examples, the steam cracker quench oil in line 141 can have a viscosity of about 250 cP, about 500 cP, about 750 cP, about 900 cP, or about 950 cP to ≤3,000 cP, ≤2,500 cP, ≤2,000 cP, ≤1,750 cP, ≤1,500 cP, or ≤1,250 cP, or ≤1,000 cP at a temperature of about 60° C., as measured according to ASTM D2171/D2171M-18. In some examples, the steam cracker quench oil in line 141 can have a final atmospheric boiling point of ≤500° C., ≤450° C., ≤400° C., ≤375° C., ≤350° C., ≤325° C. or ≤300° C., as measured according to ASTM D2887-18.

The steam cracker quench oil via line 141 and a second heat transfer medium via line 144 can be introduced into a second heat exchange stage 145 where heat can be indirectly transferred from the steam cracker quench oil to second heat transfer medium to produce a first cooled steam cracker quench oil and a heated second heat transfer medium. The first cooled steam cracker quench oil can be conducted away via line 146 and the heated second heat transfer medium can be conducted away via line 147. In some examples, the second heat transfer medium in line 144 can be water, steam, or a mixture of water and steam and the heated second heat transfer medium in line 147 can be medium pressure steam at a pressure of about 827 kPag to about 1,720 kPag.

In some examples, a portion of the first cooled steam cracker quench oil via lines 146 and 149 can be introduced into one or more storage tanks 160. In some examples, a portion of the first cooled steam cracker quench oil via lines 146 and 148 can be removed from the system 100. In some examples, while not shown, a portion of the first cooled steam cracker quench oil can be mixed, blended, combined, or otherwise contacted with the tar product in line 118. In still other examples, a portion of the first cooled steam cracker quench oil can be recycled via lines 146 and 113 as the quench fluid.

In some examples, a portion of the first cooled steam cracker quench oil via line 161 and a third heat transfer medium via line 162 can be introduced into a third heat exchange stage 165 where heat can be indirectly transferred from the first cooled steam cracker quench oil to the third heat transfer medium to produce a second cooled steam cracker quench oil and heated third heat transfer medium. The second cooled steam cracker quench oil via line 166 and the heated third heat transfer medium via line 167 can be conducted away from the second heat exchange stage 165. In some examples, the third heat transfer medium in line 162 can be water, steam, or a mixture of water and steam and the heated third heat transfer medium in line 167 can be low pressure steam at a pressure of <827 kPag. The second cooled steam cracker quench oil via line 166 can be introduced into the primary fractionator 130 as a quench or cooling medium. The second cooled steam cracker quench oil in line 166 can be at a temperature of ≤200° C. when introduced into the primary fractionator as the cooling medium. For example, the second cooled steam cracker quench oil can be at a temperature of ≥155° C. to about 160° C., about 170° C., about 180° C., or about 190° C. when introduced into the primary fractionator. The second cooled steam cracker quench oil in line 166 can have the same viscosity as the steam cracker quench oil in line 141, e.g., a viscosity of about 250 cP to about 3,000 cP at a temperature of about 60° C., as measured according to ASTM D2171/D2171M-18.

In some examples, steam cracker quench oil via line 163 from the storage tank 160 can be mixed, blended, combined, or otherwise contacted with the second cooled steam cracker quench oil in line 166. In other examples, steam cracker quench oil via line 163 can be introduced directly into the primary fractionator 130. In some examples, the steam cracker quench oil via line 163, if used, can be at a temperature of ≤200° C. when introduced into the primary fractionator as the cooling medium, e.g., a temperature of ≥155° C. to about 160° C., about 170° C., about 180° C., or about 190° C. In other examples, the steam cracker quench oil via line 163, if used, can be at a temperature of about 30° C., about 40° C., to about 60° C. or about 100° C. to about 125° C., or about 155° C.

In some examples, at least a portion of the steam cracker gas oil via line 142 and a fourth heat transfer medium via line 168 can be introduced into one or more fourth heat exchange stages 170 where heat can be indirectly transferred from the steam cracker gas oil to the fourth heat transfer medium to produce a cooled steam cracker gas oil and a heated fourth heat transfer medium. The cooled steam cracker gas oil via line 171 and the heated fourth heat transfer medium via line 172 can be conducted away from the fourth heat exchange stage 170. In some examples, the fourth heat transfer medium in line 168 can be water, steam, or a mixture of water and steam and the heated fourth heat transfer medium in line 172 can be low pressure steam or heated water that can be further heated to produce low pressure (or other) steam. The cooled steam cracker gas oil via line 171 can be introduced into the primary fractionator as a cooling or quench medium. The cooled steam cracker gas oil in line 171 can be at a temperature of ≤140° C. when introduced into the primary fractionator as quench medium. For example, the cooled steam cracker gas oil can be at a temperature of ≥100° C. to about 130° C. when introduced into the primary fractionator. In some examples, the steam cracker gas oil in line 171 can have a final atmospheric boiling point of ≤300° C., as measured according to ASTM D2887-18. In some examples, a portion of the steam cracker gas oil via lines 142 and 189 and steam via line 191 can be introduced into a steam stripper 190 and a steam stripped gas oil via line 192 and an effluent via line 193. In some examples, the effluent via line 193 can be recycled to the primary fractionator 130. In some examples, while not shown, a portion of the first cooled steam cracker gas oil via line 192 can be mixed, blended, combined, or otherwise contacted with the tar product in line 118.

Illustrative second heat exchange stages 145, third heat exchange stages 165, and fourth heat exchange stages 170 can include one or more heat exchangers commonly used in the industry such as those used on liquid pumparound process steams. If the second heat exchange stage 145, the third heat exchange stage 165, and/or the fourth heat exchange stage 170 includes a plurality of heat exchangers, the heat exchangers can be arranged in any suitable configuration, e.g., series, parallel, or a combination thereof, with respect to one another.

The primary fractionator 130, the second heat exchange stage 145, the third heat exchange stage 165, and the associated lines therebetween can be referred to as the first or bottom pump-around loop 175. The primary fractionator 130, the fourth heat exchange stage 170, and the associated lines therebetween can be referred to as the second or top pump-around loop 176. The bottom pump-around loop 175 can be in fluid communication with a bottom pump-around section of the primary fractionator 130. The top pump-around section 176 can be in fluid communication with a top pump-around section of the primary fractionator 130. The primary fractionator 130 can also include a lower or mid-fractionation section between the bottom pump-around section and the top pump-around section. The primary fractionator can also include an upper or top fractionation section above the upper pump-around section.

Returning to the mixture of steam cracker naphtha and quench water in line 152, the mixture can be introduced into one or more separators 180. The steam cracker naphtha via line 181, quench water via line 182, and recycle quench water via line 183 can be conducted away from the separator 180. The quench water via line 182 can be removed from the system, e.g., introduced into a waste water treatment process, a sour water stripper, dilution steam generation system, etc. The recycle quench water via line 183 can be recycled to the quench tower 150. In some examples, the recycle quench water via line 183 can be cooled, e.g., by air and/or water, and recycled to the quench tower 150. In some examples, the recycle quench water via line 183 can be recycled to the quench tower 150 as a single return and/or split into multiple returns to the quench tower 150 and/or other process equipment.

A portion of the steam cracker naphtha via lines 181 and 184 and steam via line **184*a* can be introduced into a reboiled distillate stripper 186 and a steam stripped steam cracker naphtha via line 187 and a waste effluent via line 188 can be conducted therefrom. A portion of the steam cracker naphtha in line 181 can be recycled to the top fractionation section as a reflux via line 185. The steam cracker naphtha in line 181 can have a final boiling point of ≤260° C., as measured according to ASTM D2887-18. In some examples, the steam cracker naphtha can have a final boiling point of about 220° C., about 221° C., about 225° C., or about 230° C. to about 235° C., about 240° C., about 245° C., about 250° C., or about 255° C. In some examples, the amount of steam cracker gas oil via line 189 conducted away from the primary fractionator 130 can be controlled or adjusted to maintain recovery of a steam cracker naphtha in line 181** that has a final boiling point of ≤260° C., as measured according to ASTM D2887-18.

The amount of steam cracker naphtha recycled via line 185 relative to the cooled light product via line 126 introduced into the primary fractionator 130 can be adjusted or controlled to achieve the desired final boiling point of the steam cracker naphtha. In some examples, the steam cracker naphtha via line 185 can be introduced into the primary fractionator 130, relative to a weight of hydrocarbons in the steam cracker effluent in line 112, at a weight ratio of about 0.2:1, about 0.23:1, about 0.25:1, about 0.27:1, or about 0.3:1 to about 0.33:1, about 0.35:1, about 0.37:1, about 0.4:1, about 0.43:1, or about 0.45:1.

Figure 2:
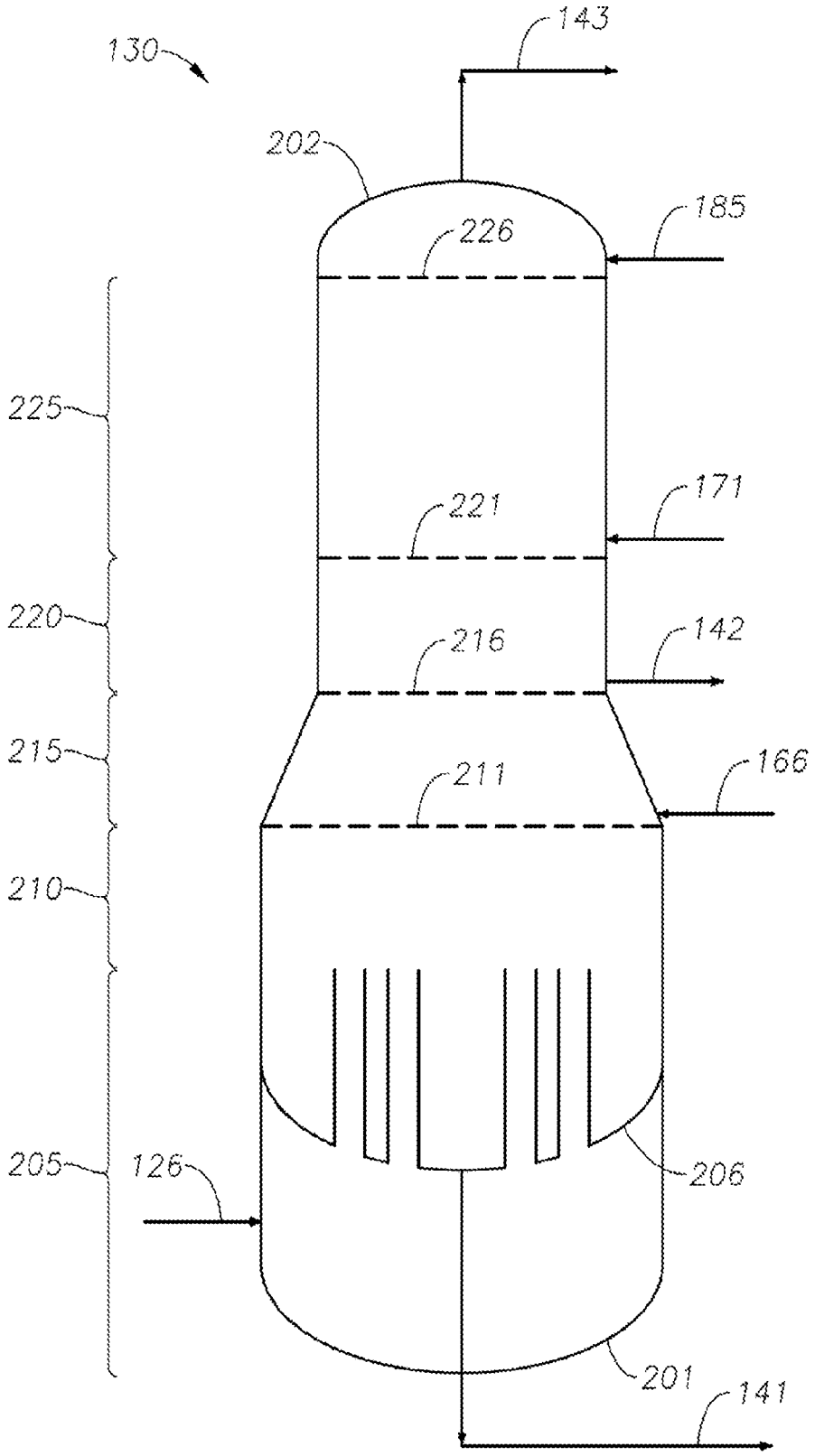
FIG. 2 depicts an elevational cross-sectional view of a primary fractionator shown in FIG. 1, according to one or more embodiments described.

FIG. 2 depicts an elevational cross-sectional view of the primary fractionator 130 shown in FIG. 1, according to one or more embodiments. The primary fractionator 130 can include a flash zone section 205 located toward a first or bottom end 201 of the primary fractionator 130, a first or bottom pump-around section 210 located above the flash zone section 205, a first or mid-fractionation section 215 located above the bottom pump-around section 210, a second or top pump-around section 220 located above the mid-fractionation section 215, and a second or top fractionation section 225 located toward a second or top end 202 of the primary fractionator 130 and above the top pump-around section 220. The cooled light product via line 126 can be introduced into the flash zone section 205 and the steam cracker quench oil via line 141 can be conducted away from the flash zone section 205.

The flash zone section 205 can include one or more vapor distribution devices 206 disposed therein. The vapor distribution device 206 can provide a pressure drop within the primary fractionator 130, facilitate the distribution of vapors within the flash zone section 205, and/or direct quench oil in the cooled light product toward the bottom 201 of the primary fractionator 130. Illustrative vapor distribution devices can include, but are not limited to, one or more chimney trays, one or more vapor horns, V-baffles, annular baffles, annular rings, vane inlet devices, half-pipe distributors, perforated pipe distributors, or any combination thereof.

The bottom pump-around section 210, the mid-fractionation section 215, the top pump-around section 220, and the top fractionation section 225 can independently include one or more internal structures or bodies 211, 216, 221, 226, respectively. The internal structure(s) can facilitate vapor/liquid separation. Illustrative internal structures can include, but are not limited to, trays, grids, packing, or any combination thereof. Illustrative trays can include, but are not limited to, fixed valve trays, jet tab trays, sieve trays, dual flow trays, baffle trays, angle iron trays, or any combination thereof. Suitable fixed valve trays, sieve trays, dual flow trays, and grids can include those disclosed in Distillation Design, Henry Z. Kister, McGraw-Hill Inc., 1992, pages 262 to 265 and pages 464-466. Suitable jet tab trays can include those disclosed in WO Publication No. WO2011/014345.

In some examples, the bottom pump-around section 210, the mid-fractionation section 215, the top pump-around section 220, and the top fractionation section 225 can independently include 1, 2, 3, 4, 5, 6, 7, 8, 9, 10, or more internal structures, e.g., trays. In some, examples the bottom pump-around section 210, the top pump-around section 220, or both the bottom pump-around section 210 and the top pump-around section 220 can include one or more trays, e.g., jet tab trays. In other examples, the bottom pump-around section 210 and the top pump-around section 220 independently include 1, 2, 3, 4, 5, 6, 7, 8, 9, 10 or more trays, e.g., jet tab trays, multiple pass trans, and/or baffle trays. In other examples the bottom pump-around section 210 and the top pump-around section 220 independently include 1, 2, 3, 4, 5, 6, 7, 8, 9, 10 or more trays, e.g., jet tab trays, multiple pass trans, and/or baffle trays, having 2, 3, 4, 5, 6, or more liquid passes.

In some examples, the second cooled steam cracker quench oil via line 166, the cooled steam cracker gas oil via line 171, and the cooled steam cracker naphtha via line 185 can be introduced into the bottom pump-around section 210, the top pump-around section 220, and the top fractionation section 225 of the primary fractionator 130 above the upper most internal structure 211, 221, and 226, respectively, disposed therein. In other examples, the second cooled steam cracker quench oil via line 166, the cooled steam cracker gas oil via line 171, and the cooled steam cracker naphtha via line 185 can be introduced into the bottom pump-around section 210, the top pump-around section 220, and the top fractionation section 225 of the primary fractionator 130 below the upper most internal structure 211, 221, and 226, respectively, disposed therein. In still other examples, when two or more internal structures are disposed within a given section, the second cooled steam cracker quench oil via line 166, the cooled steam cracker gas oil via line 171, and the cooled steam cracker naphtha via line 185 can be introduced into the bottom pump-around section 210, the top pump-around section 220, and the top fractionation section 225 of the primary fractionator 130 between the upper most internal structures 216, 221, and 226, and the lower most internal structures (not shown), respectively.

Continuing with reference to FIGS. 1 and 2, the one or more hydrocarbons in line 101 that can be mixed, blended, combined, or otherwise contacted with water, steam, or a mixture thereof and heated to produce the heated mixture can include any one or more of a number of hydrocarbons. In some examples, the hydrocarbon can include $C_{5+}$ hydrocarbons. Feeds or hydrocarbon feeds that include $C_{5+}$ hydrocarbons that can be mixed, blended, combined, or otherwise contacted with the water and/or steam in line 102 to produce the mixture in line 103 can be or include, but is not limited to, raw crude oil, steam cracked gas oils and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams such as vacuum pipestill bottoms and wide boiling range vacuum pipestill naphtha to gas oil condensates, heavy non-virgin hydrocarbons from refineries, vacuum gas oils, heavy gas oil, naphtha contaminated with crude, atmospheric residue, heavy residue, a C4's/residue admixture, naphtha/residue admixture, hydrocarbon gases/residue admixture, hydrogen/residue admixtures, waxy residues, gas oil/residue admixture, or any mixture thereof. In other examples, the hydrocarbon can be or include, naphtha, gas oil, vacuum gas oil, waxy residues, atmospheric residues, residue admixtures, crude oil, or any mixture thereof. In some examples, the hydrocarbon in line 101 can be or include light alkanes, e.g., ethane and/or propane, heavy hydrocarbons, e.g., naphtha, gas oil, vacuum gas oil, waxy residues, atmospheric residues, residue admixtures, crude oil, or a mixture thereof, and any hydrocarbon(s) therebetween.

In some examples, if the hydrocarbon feed in line 101 includes crude oil or one or more fractions thereof, the crude oil can be desalted prior to contacting with the water and/or steam. In some examples, a crude oil fraction can be produced by separating atmospheric pipestill ("APS") bottoms from a crude oil followed by vacuum pipestill ("VPS") treatment of the APS bottoms. In some examples, the hydrocarbon feed in line 101 can be or include a crude oil such as a high-sulfur virgin crude oil rich in polycyclic aromatics or a fraction thereof.

In other examples, the hydrocarbon feed in line 101 can be or include a hydroprocessed hydrocarbon, e.g., a crude or resid-containing fraction thereof. In other examples, the hydrocarbon can be or include a vapor phase separate from a vacuum resid subjected to a thermal conversion process in a thermal conversion reactor, e.g., a delayed coker, a fluid coker, a flex-coker, a visbreaker, and/or a catalytic hydrovisbreaker). In some examples, the hydrocarbon in line 101 can be or include the hydrocarbons or hydrocarbon feedstocks disclosed in U.S. Pat. Nos. 7,993,435; 8,696,888; 9,327,260; 9,637,694; 9,657,239; and 9,777,227; and International Patent Application Publication No. WO 2018/111574.

The mixture in line 103 that includes the hydrocarbon feed and the water and/or steam can include about 10 wt. %, about 20 wt. %, or about 30 w % to about 70 wt. %, about 80 wt. %, about 90 wt. %, or about 95 wt. % of the water and/or steam, based on a combined weight of the hydrocarbon and the water and/or steam. The mixture in line 103 that includes the hydrocarbon feed and the water and/or steam can be heated within the convection section of the steam cracker 105 to a temperature of about 425° C., about 450° C., about 475° C., about 500° C., about 515° C., or about 530° C. to about 540° C., about 555° C., about 565° C., or about 585° C.

It should be understood that, while not shown, in some examples the heated hydrocarbon conducted away from the convection section via line 108 can be separated into a vapor phase product and a liquid phase product, e.g., via one or more flash drums or other separator(s). In some examples, the separator that can separate the heated hydrocarbon in line 108 into a vapor phase product and a liquid phase product can be used to operate the process with a wider range of hydrocarbon feeds in line 101, e.g., the operability of the steam cracker 105 and/or the primary fractionator can work when using a wider range of hydrocarbon feeds in line 101. In some examples, the first liquid phase product can include hydrocarbons having a minimum boiling point of about 500° C. to about 570° C., about 520° C. to about 550° C., or about 530° C. to about 545° C., as measured according to ASTM D6352-15 or ASTM D2887-16a. Those skilled in the art will appreciate that should an indicated boiling point fall outside the range specified in one or more of these standards, it can be determined by extrapolation. The vapor phase product can be subjected to steam cracking conditions within the radiant section 109 of the steam cracker 105 sufficient to produce the steam cracker effluent via line 112.

In some examples, the heated mixture can be produced and the vapor phase product and the liquid phase produce can be separated therefrom according to the processes and systems disclosed in U.S. Pat. Nos. 7,993,435; and 9,777,227. Some illustrative vapor/liquid separation devices and separation stages that can be used to separate the vapor phase product and the liquid phase produce from the heated mixture can also include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705.

In some examples, a vapor phase product and a liquid phase product can be separated from the heated mixture in line 108 that includes steam and a hydrocarbon such as naphtha, gas oil, vacuum gas oil, waxy residues, atmospheric residues, residue admixtures, crude oil, or a mixture thereof. The vapor phase product can be exposed or otherwise subjected to a temperature of ≥400° C. under steam cracking conditions to produce the steam cracker effluent via line 112 that can be at least partially in a gas phase.

In some examples, a vapor phase product and a liquid phase product can be separated from the heated mixture in line 108 that includes steam and the hydrocarbon, the liquid phase product can be further processed to produce one or more additional hydrocarbon products. For example, the first liquid phase product can be subjected to hydroprocessing conditions to produce a hydroprocessed liquid phase product or first hydroprocessed product. Hydroprocessing the liquid phase product can be carried out in one or more hydroprocessing stages under hydroconversion conditions that are independently selected for each stage, e.g., under conditions for carrying out one or more of pre-treatment, hydrocracking (including selective hydrocracking), hydrogenation, hydrotreating, hydrodesulfurization, hydrodenitrogenation, hydrodemetallation, hydrodearomatization, hydroisomerization, or hydrodewaxing of the liquid phase product, as the case may be. In some examples, the liquid phase product can be hydroprocessed in one or more hydroprocessing units that can include one or more hydroprocessing vessels or zones. The hydroprocessing vessel or zone can include one or more catalysts disposed therein. The catalyst can be in the form of a fixed catalyst bed, a circulating or slurry bed, or any other configuration. The catalyst(s) and amount(s) thereof can be selected from among the same catalysts amounts specified for use in hydroprocessing the pitch-diluent mixture or the pitch-diluent-tar mixture discussed and described below. In some examples, processes and systems that can be used to hydroprocess the first liquid phase product to produce the first hydroprocessed product can include those disclosed in U.S. Pat. Nos. 9,090,836; 9,637,694; and 9,777,227; and International Patent Application Publication No. WO 2018/111574.

As noted above, the tar product in line 118 can be contacted with at least a portion of the steam stripped gas oil in line 192. In some examples, the tar product, with or without the gas oil can be further processed. For example, the tar product in line 118 can be hydroprocessed. Illustrative processes and systems that can be used to hydroprocess the tar product or a mixture of the tar product and the steam stripped quench oil or other hydrocarbon fluid can include those disclosed in U.S. Pat. Nos. 9,090,836; 9,637,694; and 9,777,227; and International Patent Application Publication No. WO 2018/111574.

Examples

The foregoing discussion can be further described with reference to the following non-limiting prophetic examples.

A process simulation of the primary fractionator configuration is ran that considers primary fractionator sizing for primary fractionators that can separate 1,200 KTA, 1,500 KTA, and 1,800 KTA of ethylene. Specifically, the primary fractionator tower designs set the temperature of the effluent introduced into the primary fractionator at a temperature of 300° C. (C1) and a temperature of 225° C. (inventive examples Ex. 1-6), and a bottom pump-around return temperature of 155° C. for all examples. Table 1 below shows the furnace effluent process conditions and composition. Tables 2 and 3 below summarize the tower operating and process conditions. The comparative example C1 does not include a vapor cooler, whereas Examples 1-6 include the vapor cooler 125. The heat duty for the vapor cooler 125 and heat exchange stages 145, 165, and 170 are shown in Tables 1, 2 and 3. In Table 2, the number of passes in the jet trays is 2 and refers to the jet trays located within the bottom pump-around section 210 of the primary fractionator 130. In Table 3, the number of passes in the jet trays is 4 and refers to the jet trays located within the bottom pump-around section 210 of the primary fractionator 130.

TABLE 1

| Furnace Effluent | |
|---|---|
| Flowrate | 1,033.90 t/hr |
| Temperature | 658° C. |
| Pressure | 310.3 kPa |
| Composition | |
| Water | 33.3 wt. % |
| Methane and lighter | 6.5 wt. % |
| C2 hydrocarbons | 17.7 wt. % |
| C3 hydrocarbons | 9.9 wt. % |
| C4 hydrocarbons | 7.0 wt. % |
| C5 hydrocarbons | 3.7 wt. % |
| Benzene | 2.0 wt. % |
| Toluene | 1.8 wt. % |
| C6-C8 hydrocarbons | 4.9 wt. % |
| C9-C10 hydrocarbons | 3.5 wt. % |
| SCGO (200° C.-260° C.) | 2.9 wt. % |
| Tar (260° C.+) | 6.8 wt. % |
| Total | 100.0 wt. % |

TABLE 2

| # of passes in Jet Trays is 2 | | | | | | | |
|---|---|---|---|---|---|---|---|
| Ex. | Capacity (KTA) | VC 125 Outlet Temp (° C.) | VC 125 Duty (Mw) | Heat Exch. 145 Duty (Mw) | Heat Exch. 165 Duty (Mw) | Heat Exch. 170 Duty (Mw) | Bottom Dia. (m) |
| C1 | 1,200 | 300.3 | 0 | 171.4 | 170.8 | 44 | 16.55 |
| Ex. 1 | 1,200 | 225 | 224.3 | 30.1 | 87.5 | 44 | 11.43 |
| Ex. 2 | 1,500 | 225 | 280.4 | 37.6 | 109.3 | 55 | 12.8 |
| Ex. 3 | 1,800 | 225 | 336.4 | 45.2 | 131.2 | 66 | 14.02 |

TABLE 3

| # of passes of Jet Trays is 4 | | | | | | | |
|---|---|---|---|---|---|---|---|
| Ex. | Capacity (KTA) | VC 125 Outlet Temp (° C.) | VC 125 Duty (Mw) | Heat Exch. 145 Duty (Mw) | Heat Exch. 165 Duty (Mw) | Heat Exch. 170 Duty (Mw) | Bottom Dia. (m) |
| C2 | 1,200 | 300.3 | 0 | 171.4 | 170.8 | 44 | 15.09 |
| Ex. 4 | 1,200 | 225 | 224.3 | 30.1 | 87.5 | 44 | 11.08 |
| Ex. 5 | 1,500 | 225 | 280.4 | 37.6 | 109.3 | 55 | 12.4 |
| Ex. 6 | 1,800 | 225 | 336.4 | 45.2 | 131.2 | 66 | 13.59 |

Tables 2 and 3 illustrate some of the advantages of the processes and systems disclosed herein. The current art is a conventional primary fractionator system that does not include a vapor cooler (example C1). The tower diameter required is 16.55 m which is larger than the largest tower currently built in the industry that has a tower diameter of 15.24 m. As shown in Table 3, employing additional multi-pass Jet Trays can reduce the diameter of this case to a more feasible 15.09 m.

A tar knock out drum and direct vapor cooler system is shown as the second case (Ex. 1-6). The process gas is cooled from 300° C. to 225° C. by the vapor cooler 125. This cooling condenses out liquid and reduces the vapor load on the downstream primary fractionator tower. This configuration is also found to have a significant energy advantage over the conventional system. The vapor cooler transfers heat directly to medium pressure utility steam while the conventional system utilizes a liquid pumparound to generate the same medium pressure utility steam. Both configurations remove heavy tar molecules at 300° C., but the maximum temperature of the conventional pumparound system is only 225-235° C., as opposed to 300° C. when the vapor cooler 125 is used. The ability to recover heat from 300° C. instead of 225-235° C. allows additional higher level heat recovery. The conventional system only recovers about 50% of the heat to medium pressure steam while the knock out drum/vapor cooler system recovers about 74% to medium pressure steam.

The tar knock out drum/vapor cooler system also allows larger plant sizes than can be built using the conventional system. Examples. 2, 3, 5, and 6 give data for 1,500 KTA and 1,800 KTA of ethylene capacity. The 1,800 KTA capacity plant has a bottom section diameter of only 14.0 m, which is still less than the current industry experience of 15.24 m (50.0 ft).

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A process for fractionating a steam cracker effluent, comprising:

contacting a steam cracker effluent with a quench oil to produce a cooled steam cracker effluent;

separating a tar product and a light product from the cooled steam cracker effluent, wherein the light product is substantially in a vapor phase and at a temperature of ≥155° C. to ≤315° C.;

indirectly transferring heat from the light product to a first heat transfer medium in a first heat exchange stage to produce a cooled light product and a first heated heat transfer medium, wherein the cooled light product is at a temperature of ≥150° C. to ≤300° C.;

introducing the cooled light product into a primary fractionator;

separating a steam cracker quench oil, a steam cracker gas oil, and an overhead product from the primary fractionator, wherein the overhead product comprises steam cracker naphtha and a process gas comprising ethylene, wherein ≥136 tons per hour of ethylene is separated from the overhead product;

separating the steam cracker naphtha and the process gas from the overhead product;

indirectly transferring heat from the steam cracker quench oil to a second heat transfer medium in a second heat exchange stage to produce a first cooled steam cracker quench oil and a second heated heat transfer medium;

indirectly transferring heat from at least a portion of the first cooled steam cracker quench oil to a third heat transfer medium in a third heat exchange stage to produce a second cooled steam cracker quench oil and a third heated heat transfer medium; and introducing at least a portion of the second cooled steam cracker quench oil into the bottom pump around section of the primary fractionator as a quench medium, wherein:

a total heat duty equal to a sum of heat duties generated in the first heat exchange stage, the second heat exchange stage, and the third heat exchange stage is equal to $Q_{T1}$ joules/sec, a heat duty equal to a sum of heat duties generated in the first heat exchange stage and the second heat exchange stage is ≥0.5 $Q_{T1}$ joules/sec, and a heat duty generated in the third heat exchange stage is <0.5 $Q_{T1}$ joules/sec.

2. The process of claim 1, wherein:

the first heat transfer medium comprises water, steam, or a mixture thereof, the heated first heat transfer medium comprises medium pressure steam at a pressure of about 827 kPag to about 1,720 kPag, the second heat transfer medium comprises water, steam, or a mixture thereof, the heated second heat transfer medium comprises medium pressure steam at a pressure of about 827 kPag to about 1,720 kPag, the third heat transfer medium comprises water, steam, or a mixture thereof, and the heated third heat transfer medium comprises low pressure steam at a pressure of <827 kPag.

3. The process of claim 1, wherein:

the heat duty equal to the sum of heat duties generated in the first heat exchange stage and the second heat exchange stage is ≥0.6 $Q_{T1}$ joules/sec, and the heat duty generated in the third heat exchange stage is ≤0.4 $Q_{T1}$ joules/sec.

4. The process of claim 1, wherein:

the heat duty equal to the sum of heat duties generated in the first heat exchange stage and the second heat exchange stage is about 0.7 $Q_{T1}$ joules/sec to about 0.95 $Q_{T1}$ joules/sec, and the heat duty generated in the third heat exchange stage is about 0.3 $Q_{T1}$ joules/sec to about 0.05 $Q_{T1}$ joules/sec.

5. The process of claim 1, wherein the second cooled steam cracker quench oil introduced into the primary fractionator as the quench medium has a viscosity of about 250 cP to about 3,000 cP at a temperature of about 60° C., as measured according to ASTM D2171/D2171M-18.

6. The process of claim 1, wherein the steam cracker effluent is produced by exposing a hydrocarbon feed to a temperature of ≥400° C. under steam cracking conditions, wherein the hydrocarbon feed comprises naphtha, gas oil, vacuum gas oil, waxy residues, atmospheric residues, residue admixtures, crude oil, or a mixture thereof.

7. The process of claim 1, wherein the second cooled steam cracker quench oil is at a temperature of ≤200° C. when introduced into the primary fractionator as the quench medium.

8. The process of claim 1, further comprising indirectly transferring heat from at least a portion of the steam cracker gas oil to a fourth heat transfer medium in a fourth heat exchange stage to produce a cooled steam cracker gas oil, wherein:

a total heat duty equal to a sum of heat duties generated in the first heat exchange stage, the second heat exchange stage, the third heat exchange stage, and the fourth heat exchange stage is equal to $Q_{T2}$ joules/sec, and a heat duty generated in the fourth heat exchange stage is about 0.05 $Q_{T2}$ to about 0.15 $Q_{T2}$.

9. The process of claim 8, wherein a heat duty equal to the sum of the heat duties generated in the first heat exchange stage and the second heat exchange stage is >0.5 $Q_{T2}$.

10. The process of claim 8, further comprising introducing a portion of the cooled steam cracker gas oil and a portion of the steam cracker naphtha into the primary fractionator, wherein:

the steam cracker quench oil is withdrawn from a first outlet into a bottom pump-around loop, the second cooled steam cracker quench oil introduced into the primary fractionator is introduced into a first inlet located above the first outlet, the steam cracker gas oil is withdrawn from a second outlet into a top pump-around loop, the second outlet located above the first inlet, the cooled steam cracker gas oil introduced into the primary fractionator is introduced into a second inlet located above the second outlet, and the steam cracker naphtha introduced into the primary fractionator is introduced into a third inlet located above the second inlet.

11. The process of claim 10, wherein:

the second cooled steam cracker quench oil introduced into the primary fractionator is introduced onto a first tray comprising two or more liquid passes, the cooled steam cracker gas oil introduced into the primary fractionator is introduced onto a second tray comprising two or more liquid passes.

12. The process of claim 1, wherein the steam cracker naphtha has a final boiling point of ≤260° C., as measured according to ASTM D2887-18.

13. The process of claim 1, wherein the cooled light product is at a temperature of ≤280° C. when introduced into the primary fractionator.

14. The process of claim 1, wherein ≥142, ≥150, ≥176, or ≥194 tons per hour of ethylene is separated from the overhead product.

15. A process for fractionating a steam cracker effluent, comprising:

contacting a steam cracker effluent with a quench fluid to produce a cooled steam cracker effluent;

separating a tar product and a light product from the cooled steam cracker effluent, wherein the light product is substantially in a vapor phase and at a temperature of ≥155° C. to ≤315° C.;

indirectly transferring heat from the light product to water, steam, or a mixture of water and steam to produce a cooled light product and a first medium pressure steam, wherein the first medium pressure steam is at a pressure of about 827 kPag to about 1,720 kPag and wherein the cooled light product is at a temperature of ≥150° C. to ≤300° C.;

introducing the cooled light product into a primary fractionator having a maximum inner diameter of ≤16.8 meters;

separating a steam cracker quench oil, a steam cracker gas oil, and an overhead product from the primary fractionator, wherein the overhead product comprises steam cracker naphtha and a process gas comprising ethylene;

separating the steam cracker naphtha and the process gas from the overhead product, wherein >136 tonnes per hour of ethylene is separated from the overhead product;

cooling the steam cracker quench oil by indirect heat exchange with water, steam, or a mixture of water and steam to produce a first cooled steam cracker quench oil and a second medium pressure steam, wherein the second medium pressure steam is at a pressure of about 827 kPag to about 1,720 kPag;

cooling at least a portion of the first cooled steam cracker quench oil by indirect heat exchange with water, steam, or a mixture of water and steam to produce a second cooled steam cracker quench oil and low pressure steam, wherein the low pressure steam is at a pressure of <827 kPag; and introducing at least a portion of the second cooled steam cracker quench oil into the primary fractionator as a quench medium.

16. The process of claim 15, wherein the steam cracker naphtha has a final atmospheric boiling point of ≤260° C., as measured according to ASTM D2887.

17. The process of claim 15, wherein:

the steam cracker naphtha has a final atmospheric boiling point of about 221° C. to about 250° C., as measured according to ASTM D2887-18, the steam cracker gas oil has a final atmospheric boiling point of ≤300° C., as measured according to ASTM D2887-18, the steam cracker quench oil has a final atmospheric boiling point of ≤500° C., as measured according to ASTM D2887-18, the tar product has a final atmospheric boiling point of >600° C., as measured according to ASTM D2887-18.

18. The process of claim 15, wherein:

a total heat duty equal to a sum of heat duties generated by cooling the light product by indirect heat exchange, cooling the steam cracker quench oil by indirect heat exchange, and cooling at least a portion of the first cooled steam cracker quench oil by indirect heat exchange is equal to $Q_{T1}$ joules/sec, a heat duty equal to a sum of heat duties generated by cooling the light product by indirect heat exchange and cooling the steam cracker quench oil by indirect heat exchange is ≥0.5 $Q_{T1}$ joules/sec, and a heat duty generated by cooling at least a portion of the first cooled steam cracker quench oil is <0.5 $Q_{T1}$ joules/sec.

19. The process of claim 15, wherein:

the primary fractionator comprises a flash zone section located toward a first end of the primary fractionator, a bottom pump-around section located above the flash zone section, a mid-fractionation section located above the bottom pump-around section, a top pump-around section located above the mid-fractionation section, and a top-fractionation section located above the top pump-around section, wherein:

one or more vapor distribution devices is disposed within the flash zone section, one or more first trays is disposed within the bottom pump-around section, one or more second trays is disposed within the mid-fractionation section, one or more third trays is disposed within the top pump-around section, and one or more fourth trays is disposed within the top-fractionation section.

20. The process of claim 19, wherein the one or more first trays comprise one or more jet tab trays, and wherein the one or more third trays comprise one or more jet tab trays.

21. The process of claim 15, further comprising introducing a portion of the steam cracker naphtha into the top-fractionation section, wherein the steam cracker naphtha is introduced into the top-fractionation section, relative to a weight of hydrocarbons in the steam cracker effluent, at a weight ratio of about 0.2:1 to about 0.45:1.

22. A process for fractionating a steam cracker effluent, comprising:

contacting a steam cracker effluent with a quench fluid to produce a cooled steam cracker effluent, wherein the steam cracker effluent is at a temperature of ≥400° C. when initially contacted with the quench fluid;

separating a tar product and a light product from the cooled steam cracker effluent, wherein the light product is substantially in a vapor phase and at a temperature of ≥155° C. to ≤315° C.;

cooling the light product by indirect heat exchange with water, steam, or a mixture of water and steam to produce a cooled light product and a first medium pressure steam, wherein the cooled light product is at a temperature of ≥150° C. to ≤300° C., wherein the first medium pressure steam is at a pressure of about 827 kPag to about 1,720 kPag, and wherein the cooled light product is in the vapor phase and liquid phase;

introducing the cooled light product into a flash zone section of a primary fractionator, wherein the cooled light product is at a temperature of ≥150° C. to ≤280° C. when introduced into the primary fractionator, and wherein the primary fractionator comprises the flash zone section located toward a bottom of the primary fractionator, a bottom pump-around section located above the flash zone, a mid-fractionation section located above the bottom pump-around section, a top pump-around section located above the mid-fractionation section, and a top-fractionation section located above the top pump-around section, wherein:

one or more first trays is disposed within the bottom pump-around section and wherein the one or more first trays including a plurality of liquid passes, one or more second trays is disposed within the mid-fractionation section, one or more third trays is disposed within the top pump-around section, and one or more fourth trays is disposed in the top-fractionation section;

separating a steam cracker quench oil from the flash zone section;

separating a steam cracker gas oil from the mid-fractionation section;

separating an overhead product comprising steam cracker naphtha and a process gas comprising ethylene from the top-fractionation section, wherein ≥136 tons per hour of ethylene is separated from the overhead product;

separating the steam cracker naphtha and the process gas from the overhead product, wherein the steam cracker naphtha has a final atmospheric boiling point of ≤260° C., as measured according to ASTM D2887-18;

cooling the steam cracker quench oil by indirect heat exchange with water, steam, or a mixture of water and steam to produce a first cooled steam cracker quench oil and a second medium pressure steam, wherein the second medium pressure steam is at a pressure of about 827 kPag to about 1,720 kPag;

cooling at least a portion of the first cooled steam cracker quench oil by indirect heat exchange with water, steam, or a mixture of water and steam to produce a second cooled steam cracker quench oil and low pressure steam, wherein the low pressure steam is at a pressure of <827 kPag; and introducing a portion of the steam cracker naphtha into the top-fractionation section, wherein the steam cracker naphtha is introduced into the top-fractionation section, relative to a weight of hydrocarbons in the steam cracker effluent, at a weight ratio of about 0.2:1 to about 0.45:1.

23. The process of claim 22, wherein the flow rate of the portion of the steam cracker naphtha introduced into the top-fractionation section, the flow rate of the steam cracker gas oil recovered from the fractionation section, and the temperature of the cooled light product introduced into the primary fractionator are adjusted to maintain a predetermined vapor and liquid loading on (1) the one or more first trays, (2) the one or more second trays, (3) the one or more third trays, (4) the one or more fourth trays, or (5) a combination thereof.

* * * * *